US007942082B1

(12) United States Patent
Jones

(10) Patent No.: US 7,942,082 B1
(45) Date of Patent: May 17, 2011

(54) CRANKABLE HAND WRENCH

(76) Inventor: James M. Jones, Florence, OR (US)

( * ) Notice: Subject to any disclaimer, the term of this patent is extended or adjusted under 35 U.S.C. 154(b) by 0 days.

(21) Appl. No.: 12/927,428

(22) Filed: Nov. 15, 2010

(51) Int. Cl.
*B25B 23/16* (2006.01)
*B25B 13/46* (2006.01)

(52) U.S. Cl. ..... 81/177.8; 81/30; 81/60

(58) Field of Classification Search ..... 81/177.8, 81/60, 177.6, 30, 177.7, 35, 440
See application file for complete search history.

(56) References Cited

U.S. PATENT DOCUMENTS

| | | | | | |
|---|---|---|---|---|---|
| 354,085 | A | * | 12/1886 | Baker | 81/30 |
| 1,559,097 | A | * | 10/1925 | Hill | 81/177.2 |
| 2,465,152 | A | | 3/1949 | Ellison | |
| 2,836,210 | A | * | 5/1958 | Garofalo | 81/440 |
| 3,526,160 | A | | 9/1970 | Thurber | |
| 4,607,406 | A | * | 8/1986 | Davis, Jr. | 81/177.6 |
| 5,313,860 | A | * | 5/1994 | Liou | 81/177.6 |
| 5,511,452 | A | * | 4/1996 | Edmonds | 81/35 |
| 5,517,884 | A | | 5/1996 | Sanders | |
| 5,699,701 | A | * | 12/1997 | Cotten, Jr. | 81/177.6 |
| 5,782,442 | A | | 7/1998 | Kwak et al. | |
| 6,349,620 | B1 | | 2/2002 | Anderson | |
| 7,197,965 | B1 | | 4/2007 | Anderson | |
| 7,347,403 | B2 | | 3/2008 | Belcourt et al. | |

* cited by examiner

*Primary Examiner* — Hadi Shakeri
(74) *Attorney, Agent, or Firm* — John R. Flanagan

(57) ABSTRACT

A crankable hand wrench includes an elongated main handle having opposite end portions, opposite faces extending between the opposite end portions, and a slot in the main handle nearer to one than the other of the opposite end portions, a wrench head attached to and extending from at least the other of the opposite end portions of the main handle, and a crank assembly incorporated by the main handle. The slot is formed through the main handle between the opposite faces thereof so as to open at the opposite faces. The crank assembly includes a crank handle movable between a stored position in which the crank handle is disposed within the slot and a deployed position in which the crank handle extends from the main handle so as to form a substantially L-shaped crank therewith.

16 Claims, 2 Drawing Sheets

CRANKABLE HAND WRENCH

BACKGROUND OF THE INVENTION

1. Field of the Invention

The present invention generally relates to hand wrenches and, more particularly, is concerned with a crankable hand wrench, such as a double box end ratcheting wrench.

2. Description of the Prior Art

A double box end ratcheting wrench is a hand wrench having a socket at each end. Basically, it is a very useful tool. Handle offsets, multiple bends and pivotal handles and the like have been employed in prior art designs to improve the maneuverability of the wrench. However, most prior art designs are not easy for a user to grip, maneuver and turn with any degree of comfort, speed or control. Thus, when turning a nut or bolt after loosening or before tightening, the user is unable to accomplish these tasks with a continuous, easy and fast movement of the wrench.

Thus, a need exists for an innovation, especially directed toward a double box end ratcheting wrench although not limited thereto, that will overcome these drawbacks of prior art designs.

SUMMARY OF THE INVENTION

The present invention provides a crankable hand wrench designed to overcome the above-described drawbacks and satisfy the aforementioned need. The crankable hand wrench of the present invention makes the user's work easier and quicker to do compared to many prior art designs. The feature added to the wrench by the present invention to enable or enhance its crankability is stored in the main handle of the wrench out of the way when not needed.

Accordingly, the present invention is directed to a crankable hand wrench which includes: an elongated main handle having opposite end portions, opposite faces extending between the opposite end portions, and at least one slot formed through the main handle nearer to one than the other of the opposite end portions so as to open at the opposite faces; a wrench head attached to and extending from at least the other of the opposite end portions of the main handle; and at least one crank assembly incorporated by the main handle, the crank assembly including a crank handle movable between a stored position in which the crank handle is disposed substantially within the slot and a deployed position in which the crank handle extends from said main handle so as to form a substantially L-shaped crank therewith.

More particularly, the main handle also has opposite sides extending between the opposite end portions and the opposite faces and apertures defined through the opposite sides adjacent to and open at one end of the slot proximate the one end portion of the main handle. The crank assembly also includes a transverse bore extending through one end of the crank handle in alignment with the apertures in the main handle and a hinge pin fitted through the apertures and transverse bore so as to pivotally couple the crank handle to the main handle.

The crank assembly further includes a recess formed in the main handle adjacent to and open at the one end of the slot in the main handle, and a yieldable biased body disposed in the recess and extending from the recess into the slot such that the body impose a yieldable pressing engagement against the one end of the crank handle. The one end of the crank handle has a periphery defining a plurality of end surfaces angularly displaced relative to one another and about the transverse bore in the one end of the crank handle such that the body engages one of the end surfaces at a time so as to releasably retain the crank handle at a corresponding one of the stored or deployed positions and prevent the crank handle from swinging freely.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
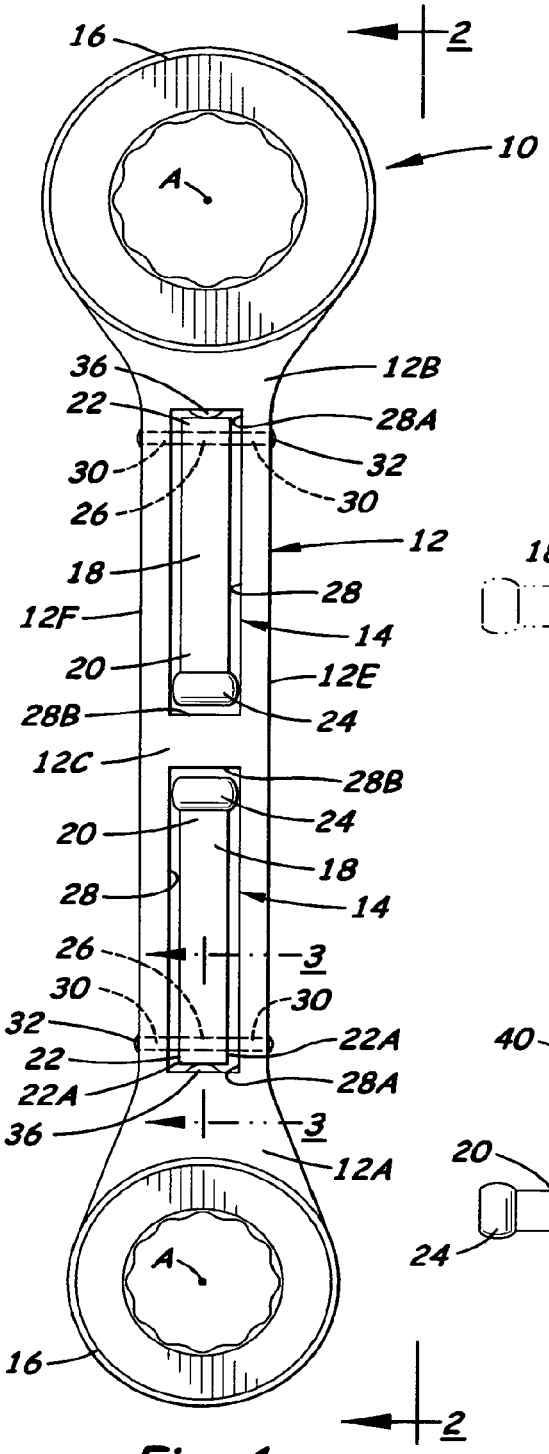
FIG. 1 is a plan view of an exemplary embodiment of a crankable hand wrench in accordance with the present invention incorporating a pair of crank assemblies with crank handles shown disposed in stored positions in the main handle of the wrench.
Figure 2:
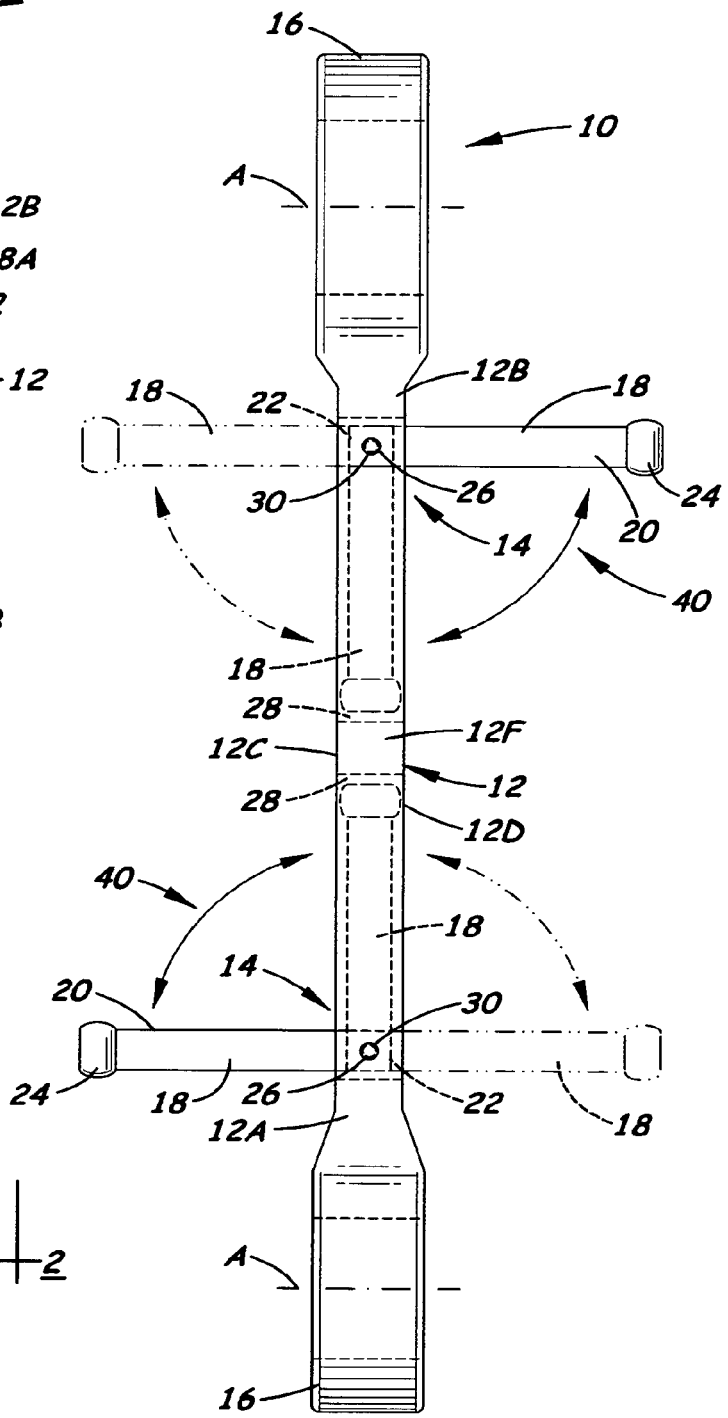
FIG. 2 is a side elevational view of the wrench as seen along line 2-2 of FIG. 1 with one crank handle pivoted laterally to a deployed position relative to the main handle and the other crank handle retained in the stored position relative to the main handle.

Referring to the drawings, and particularly to FIGS. 1 and 2, there is illustrated an exemplary embodiment of a crankable hand wrench, generally designated 10, having an elongated main handle 12 and made crankable by having at least one and, more particularly as shown, a pair of crank assemblies, generally designated 14, incorporated in the main handle 12 in accordance with the present invention. The main handle 12 has opposite end portions 12A, 12B, and opposite faces 12C, 12D and opposite sides 12E, 12F extending between the opposite end portions 12A, 12B. The hand wrench 10 illustrated in FIGS. 1 and 2 to which the crank assemblies 14 are applied is a double box end ratcheting wrench design. However, one or both of the crank assemblies 14 of the present invention may be equally applicable to other hand wrench designs.

In addition to the main handle 12, the wrench 10 includes at least one and, more particularly as shown, a pair of wrench heads 16 rigidly attached to and extending in opposite directions from opposite end portions 12A, 12B of the main handle 12. As mentioned above, the wrench 10 shown is of the double box end ratcheting wrench design which employs wrench heads 16 in the form of ratcheting heads. Each wrench head 16, defining an axis A, is designed to serve the conventional function of engaging a nut or a bolt head of a particular size that matches the wrench head 16 so that the nut or bolt may be unthreaded (or loosened) or threaded (tightened) by a user gripping the main handle 12 and turning or rotating the wrench 10 about the axis A. By incorporating at least one crank assembly 14 in the main handle 12 of the hand wrench 10 in accordance with the present invention, the user is enabled to also spin or crank the wrench 10 in order to speed up the unthreading or threading operation.

Figure 3:
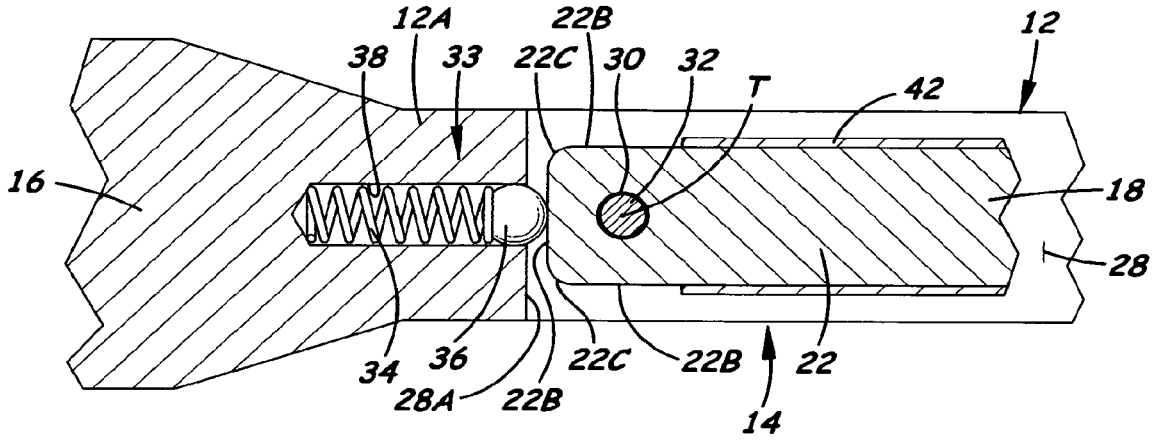
FIG. 3 is an enlarged longitudinal sectional view of one crank assembly as seen along line 3-3 of FIG. 1 showing the crank handle in a stored position.
Figure 4:
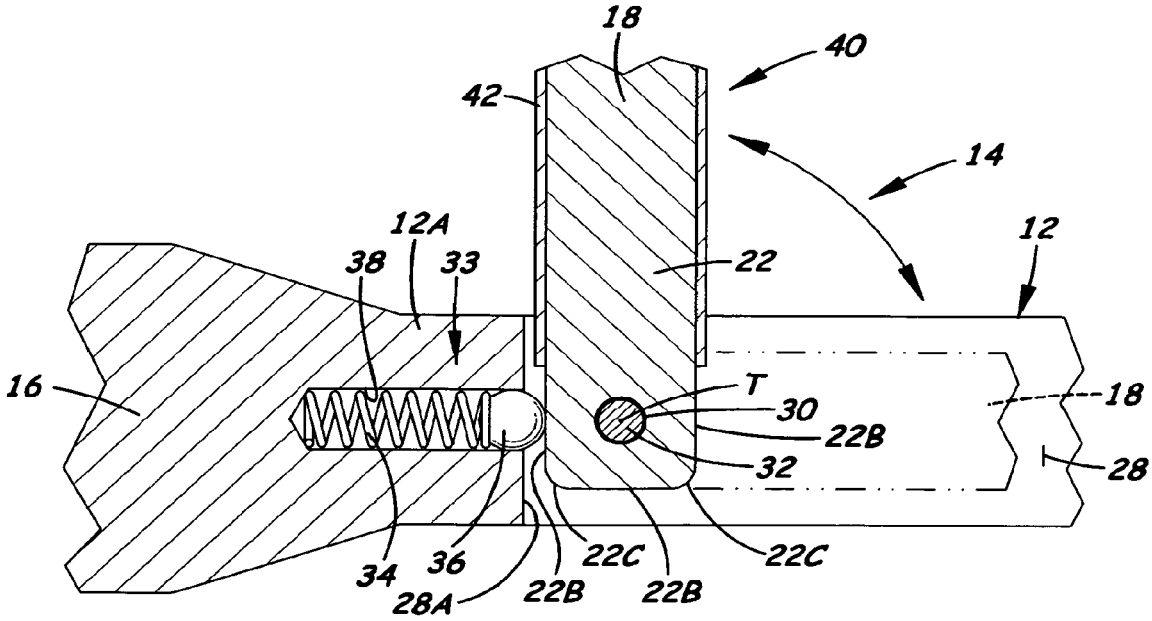
FIG. 4 is an enlarged longitudinal sectional view similar to that of FIG. 3 but now showing the crank handle in a deployed position.

More particularly, as also seen in FIGS. 3 and 4, each crank assembly 14 includes a crank handle 18, for example, in the configuration of a cylindrical rod made of a suitable metal.

The crank handle 18 has an outer end 20 and an inner end 22. The inner end 22 is formed by a pair of opposite sides 22A and has a rectangular, or more particularly a squared, profile or periphery that defines a plurality of end surfaces 22B, namely three in number, extending between the opposite sides 22A and angularly displaced relative to one another, such as at about ninety degrees. The end surfaces 22B may be interconnected with one another by rounded surfaces 22C located between them. Also, the crank handle 18 has an enlarged head 24 of rounded shape formed on its outer end 20 and a transverse bore 26 extending through the inner end 22 between and open at the opposite sides 22A thereof and transversely in relation to the length of the crank handle 18. The end surfaces 22B extend in a generally parallel spaced relationship to and about the transverse bore 26.

Each crank handle 18 is sized to fit within one of two cavities or slots 28 formed in spaced apart, aligned, end-to-end fashion in the main handle 12. (Alternatively, the two slots 28 may be portions of a single slot.) Each cavity or slot 28 extends lengthwise along the main handle 12 between its opposite end portions 12A, 12B and being open along its opposite faces 12C, 12D. Each slot 28 has opposite inner and outer ends 28A, 28B, with the inner end 28A spaced inwardly from the respective one of the opposite end portions 12A, 12B of the main handle 12. The main handle 12 also has two apertures 30 defined through the opposite sides 12E, 12F of the main handle 12 and located adjacent to the inner end 28A of each slot 28 in alignment with each other across the slot 28 and also aligned with the transverse bore 26 through the crank handle 18.

Each crank assembly 14 also includes a hinge pin 32 that threadably fits through the apertures 30 formed in the main handle 12 and extends through the transverse bore 26 formed through the inner end 22 of the crank handle 18. In such manner, the hinge pin 32 extending through the apertures 30 in the main handle 12 and the bore 26 in the inner end 22 of the crank handle 18 pivotally couples the inner end 22 of the crank handle 18 to the main handle 12 for enabling the crank handle 18 to undergo lateral pivotal movement toward and away from the main handle 12 about a transverse axis T defined by the hinge pin 32 and apertures 30. The crank handle 18 may be pivoted through about 180 degrees between a stored position, as shown in FIG. 1, in which the crank handle 18 is disposed within the respective one slot 28, and opposing deployed positions, as shown in FIG. 4, in which the crank handle 18 extends laterally, in either direction from the slot 28, at either side of the main handle 12 in a generally transverse relationship to the main handle 12 and in a generally parallel relationship to the axis A of the given wrench head 16. The crank handle 18 when in either of the deployed positions can be used to rotatably crank the main handle 12 and the appropriate opposite one of the wrench heads 16 fitted on a fastener nut or bolt head about the axis A.

Each crank assembly 14 further includes a yieldable biased body 33 in the form of a spring 34, such as of the coiled type, and a pellet or ball 36, such as made of a metal alloy such as steel, seated in an end of the spring 34. The spring 34 is disposed in a pit or recess 38 formed in the main handle 12 adjacent to the respective one of the opposite end portions 12A, 12B of the main handle 12 and adjacent to the inner end 28A of the slot 28. The recess 38 opens into the slot 28. The spring 34 yieldably loads or biases the ball 36 toward the slot 28 so as to maintain engagement of ball 36 with the inner end 22 of the crank handle 18 as the latter is pivoted between the stored position and either of the deployed positions. The spring-loaded ball 36, extending from the recess 38 into the slot 28, imposes a yieldable pressing engagement against one of the plurality of end surfaces 22B on the inner end 22 of the auxiliary crank handle 18. Such yieldable pressing engagement of the spring-loaded ball 36 one at a time against the end surfaces 22B on the inner end 22 of the auxiliary crank handle 18 retains the crank handle 18 at a corresponding one of the stored and deployed positions, preventing the crank handle 18 from swinging freely, while still allowing the crank handle 18 to be pivotally moved between the positions, when desired, by a user applying a force against the crank handle 18 that overcomes the bias of the spring 34 on the ball 36. Each of the end surfaces 22B on the inner end 22 of the auxiliary crank handle 18 may also contain a detent in which the ball 36 will seat to augment the ability of the pressing engagement by the spring-loaded ball 36 to prevent the crank handle 18 from swinging freely.

Thus, the pair of crank assemblies 14 are arranged end-to-end such that from a central location on the main handle 12 of the wrench 10 between the crank assemblies 14, the components of the crank assembly 14 to the right of the central location will appear as substantially a mirror image of the components of the crank assembly 14 to the left of the central location. In FIG. 3, the crank assemblies 14 are shown disposed in stored positions relative to and within the main handle 12 of the wrench 10, whereas in FIG. 4 they are shown disposed either in solid or broken line form in deployed positions relative to the main handle 12. The wrench heads 16 attached to the respective opposite end portions 12A, 12B of the main handle 12 and spaced from the slot 28 in the main handle 12 define the respective axes A extending generally transverse to the main handle 12. The rounded surfaces 22C enable ease of movement of the crank handle 18 and the end surfaces 22B relative to the spring-loaded ball 36.

The placement of each crank handle 18 in the cavity or slot 28 of the main handle 12 with the inner end 22 of the crank handle 18 pivotally coupled to the main handle 12 enables the respective crank handle 18 to undergo lateral pivotal movement toward and away from the main handle 12 about the transverse axis T from the stored position in which the crank handle 18 is disposed within the main handle slot 28 out of the way when not in use. Then, when disposed in either deployed position, the crank handle 18 will extend from the slot 28 at either side of the main handle 12 in a generally transverse relationship to the main handle 12, forming an L-shaped crank 40 with the main handle 12. The crank handle 18 may extend in a generally parallel relationship to the axis A of the wrench head 16 where it will enable swinging or spinning of the hand wrench 10 with a cranking motion about the axis A of the respective wrench head 16 with the engaged one of the wrench heads 16 acting as the pivot point. Centrifugal force will tend to push the user's hand that grips the crank handle 18 outward toward the outer end 20 of the crank handle 18. The enlarged head 24 formed or otherwise fitted on the outer end 20 of the crank handle 18 will tend to prevent the user's hand from slipping off the crank handle 18. In addition, as seen in FIG. 3, an expandable sleeve 42 may be placed about the crank handle 18 such that the sleeve 42 can slip relative to the crank handle 18 allowing the sleeve 42 to be gripped by the user when cranking the crank handle 18 about the axis A.

It is thought that the present invention and its advantages will be understood from the foregoing description and it will be apparent that various changes may be made thereto without departing from the spirit and scope of the invention or sacrificing all of its material advantages, the forms hereinbefore described being merely exemplary embodiments thereof.

What is claimed is:

1. A crankable hand wrench, comprising:

an elongated main handle having opposite end portions, opposite faces extending between said opposite end portions, and at least one slot formed through said main handle nearer to one than the other of said opposite end portions so as to open at said opposite faces, said main handle also having opposite sides extending between said opposite end portions and said opposite faces and apertures defined through said opposite sides adjacent to and open at one end of said slot proximate said one end portion of said main handle;

a wrench head attached to and extending from at least said other of said opposite end portions of said main handle; and at least one crank assembly incorporated by said main handle, said crank assembly including a crank handle movable between a stored position in which said crank handle is disposed substantially within said slot and a deployed position in which said crank handle extends from said main handle so as to form a substantially L-shaped crank therewith, said crank assembly also including a transverse bore extending through one end of said crank handle in alignment with said apertures in said main handle and a hinge pin fitted through said apertures and transverse bore so as to pivotally couple said crank handle to said main handle;

wherein said crank assembly further includes a recess formed in said main handle adjacent to and open at said one end of said slot in said main handle, and a yieldable biased body disposed in said recess and extending from said recess into said slot such that said body imposes a yieldable pressing engagement against said one end of said crank handle.

2. The wrench of claim 1 wherein said yieldable biased body is a spring disposed in said recess and a ball seated in said spring and projecting from said recess into said slot of said main handle.

3. The wrench of claim 1 wherein said one end of said crank handle has a periphery defining a plurality of end surfaces angularly displaced relative to one another and about said transverse bore in said one end of said crank handle such that said body engages one of said end surfaces at a time so as to releasably retain said crank handle at a corresponding one of said stored or deployed positions and prevent said crank handle from swinging freely.

4. The wrench of claim 3 wherein said one end of said crank handle also has rounded surfaces located between and interconnecting said end surfaces to enable movement of said crank handle and the end faces on said one end thereof relative to yieldable pressing engagement by said body against said one end of said crank handle.

5. The wrench of claim 3 wherein said end surfaces are angularly displaced relative to one another by approximately ninety degrees.

6. The wrench of claim 1 wherein said crank assembly also includes a sleeve fitted about said crank handle such that said sleeve can slip relative to said crank handle.

7. The wrench of claim 1 wherein said crank handle has an enlarged head on an opposite end of said crank handle that will inhibit a hand of a user gripping said crank handle from sliding off said crank handle during the cranking thereof.

8. The wrench of claim 1 wherein said wrench head is a ratcheting head.

9. A crankable hand wrench, comprising:

an elongated main handle having opposite end portions, opposite faces extending between said opposite end portions, and slot portions formed through said main handle so as to open at said opposite faces thereof, each of said slot portions having an end disposed proximate one of said end portions of said main handle, said main handle also having opposite sides extending between said opposite end portions and said opposite faces and apertures defined through said opposite sides adjacent to and open at one end of said slot proximate said one end portion of said main handle;

a pair of wrench heads each attached to and extending from one of said end portions of said main handle; and a pair of crank assemblies incorporated by said main handle, each crank assembly including a crank handle movable between a stored position in which said crank handle is disposed substantially within one of said slot portions and a deployed position in which said crank handle extends from said main handle so as to form a substantially L-shaped crank therewith, said crank assembly also including a transverse bore extending through one end of said crank handle in alignment with said apertures in said main handle and a hinge pin fitted through said apertures and transverse bore so as to pivotally couple said crank handle to said main handle;

wherein said crank assembly further includes a recess formed in said main handle adjacent to and open at said one end of said slot in said main handle, and a yieldable biased body disposed in said recess and extending from said recess into said slot such that said body imposes a yieldable pressing engagement against said one end of said crank handle.

10. The wrench of claim 9 wherein said yieldable biased body is a spring disposed in said recess and a ball seated in said spring and projecting from said recess into said slot of said main handle.

11. The wrench of claim 9 wherein said one end of said crank handle has a periphery defining a plurality of end surfaces angularly displaced relative to one another and about said transverse bore in said one end of said crank handle such that said body engages one of said end surfaces at a time so as to releasably retain said crank handle at a corresponding one of said stored or deployed positions and prevent said crank handle from swinging freely.

12. The wrench of claim 11 wherein said one end of said auxiliary crank handle also has rounded surfaces located between and interconnecting said end surfaces to enable movement of said crank handle and the end faces on said one end thereof relative to yieldable pressing engagement by said body against said one end of said crank handle.

13. The wrench of claim 11 wherein said end surfaces are angularly displaced relative to one another by approximately ninety degrees.

14. The wrench of claim 9 wherein said crank assembly also includes a sleeve fitted about said auxiliary crank handle such that said sleeve can slip relative to said crank handle.

15. The wrench of claim 9 wherein said crank handle has an enlarged head on an opposite end of said crank handle that will inhibit a hand of a user gripping said crank handle from sliding off said crank handle during the cranking thereof.

16. The wrench of claim 9 wherein each of said wrench heads is a ratcheting wrench head.

* * * * *